US007960668B2

(12) United States Patent
Fethke et al.

(10) Patent No.: US 7,960,668 B2
(45) Date of Patent: Jun. 14, 2011

(54) METHOD AND DEVICE FOR SORTING POSTAL ITEMS

(75) Inventors: Christoph Fethke, Münster (DE); Jürgen Raβkopf, Rommerskirchen (DE); Robert Egg, Aichach (DE); Joachim Ziegeler, Sulzbach-Rosenberg (DE)

(73) Assignee: Deutsche Post AG, Bonn (DE)

( * ) Notice: Subject to any disclaimer, the term of this patent is extended or adjusted under 35 U.S.C. 154(b) by 701 days.

(21) Appl. No.: 11/660,583

(22) PCT Filed: Aug. 5, 2005

(86) PCT No.: PCT/EP2005/008509

§ 371 (c)(1),
(2), (4) Date: May 13, 2008

(87) PCT Pub. No.: WO2006/018159

PCT Pub. Date: Feb. 23, 2006

(65) Prior Publication Data

US 2008/0257798 A1 Oct. 23, 2008

(30) Foreign Application Priority Data

Aug. 18, 2004 (DE) ..... 10 2004 040 100

(51) Int. Cl.
*B07C 5/00* (2006.01)

(52) U.S. Cl. ..... 209/584; 209/703; 209/900; 209/923

(58) Field of Classification Search ..... 700/223–227; 209/583, 584, 703, 900, 922, 923, 942
See application file for complete search history.

(56) References Cited

U.S. PATENT DOCUMENTS

| | | | | | |
|---|---|---|---|---|---|
| 3,759,381 | A * | 9/1973 | Mercadie et al. | ..... | 209/559 |
| 3,884,370 | A * | 5/1975 | Bradshaw et al. | ..... | 198/350 |
| 4,776,467 | A | 10/1988 | Hayasaki | ..... | 209/620 |
| 4,963,251 | A * | 10/1990 | Bohm et al. | ..... | 209/564 |
| 5,385,243 | A * | 1/1995 | Jackson et al. | ..... | 209/509 |
| 5,419,457 | A * | 5/1995 | Ross et al. | ..... | 209/616 |
| 5,460,272 | A * | 10/1995 | Ryll | ..... | 209/583 |
| 5,518,122 | A * | 5/1996 | Tilles et al. | ..... | 209/539 |
| 6,079,570 | A * | 6/2000 | Oppliger et al. | ..... | 209/630 |
| 6,554,123 | B2 * | 4/2003 | Bonnet | ..... | 198/370.04 |
| 6,784,391 | B2 * | 8/2004 | Takizawa | ..... | 209/583 |
| 6,953,906 | B2 * | 10/2005 | Burns et al. | ..... | 209/584 |
| 7,166,814 | B2 * | 1/2007 | Nakanishi et al. | ..... | 209/584 |

FOREIGN PATENT DOCUMENTS

| | | |
|---|---|---|
| DE | 1 054 015 | 3/1959 |
| DE | 1 054 380 | 4/1959 |
| DE | 36 37 835 | 9/1988 |
| DE | 695 18 293 | 3/2001 |
| DE | 201 21 614 | 3/2003 |

(Continued)

*Primary Examiner* — Joseph C Rodriguez
(74) *Attorney, Agent, or Firm* — Marshall, Gerstein & Borun LLP

(57) ABSTRACT

A method and device for sorting postal items according to formats, wherein postal items having at least two formats are fed by first conveyor to a sorting location; postal items of a first format are removed from the first conveyor in the area of the sorting location at a number of sorting stations arranged one behind the other in a direction of conveyance of the first conveyor, and are fed to a second conveyor, which, in the area of the sorting location, extends laterally next to the first conveyor, and; the postal items with other formats remain on the first conveyor.

18 Claims, 7 Drawing Sheets

FOREIGN PATENT DOCUMENTS

| | | |
|---|---|---|
| DE | 103 26 495 | 8/2004 |
| EP | 0 439 674 | 8/1991 |
| JP | 58-076 169 | 5/1983 |
| WO | WO-03/035527 | 5/2003 |

* cited by examiner

LINE C-C

LINE B-B

LINE A-A

METHOD AND DEVICE FOR SORTING POSTAL ITEMS

BACKGROUND OF THE INVENTION

1. Field of the Invention

The invention relates to a method for sorting mailpieces according to their formats.

The invention also relates to a device suited for carrying out the method.

2. Related Technology

The method and the device are especially suited for processing incoming mail in a distribution center of a postal service provider.

This is where mailpieces that have been mailed by their senders in a mailbox of the postal service provider or that have been dropped off at a branch of the postal service provider or at another drop-off location typically arrive in an unsorted order to start with.

In order to prepare the further transport of the mailpieces to their destinations, the mailpieces are normally sorted in the distribution centers of the postal service provider according to their destinations or according to destination regions comprising several destinations. This is done in several sorting machines that are each configured for sorting mailpieces of a certain range of formats.

Therefore, it is necessary to first sort the mailpieces that have arrived at a distribution center according to mail classes and mail formats, so that they can be fed to the appropriate sorting machines. Moreover, the mailpieces have to be combined into ordered stacks so that they can be fed to the sorting machines without any problems.

The state of the art describes various methods and devices for sorting mailpieces according to their formats.

DE 201 21 614 U1, for example, discloses a sorting device having a conveying means with a plurality of crosswise connections on which eccentric elements are arranged that, together with adjacent crosswise connections, delimit passage openings. A rotational movement of the eccentric elements moves letters in a conveying direction, whereby letters with a small format fall through the passage openings, thus being sorted out of the mail stream.

This method has especially the drawback that the large-format mailpieces that occur in a much smaller number within the total mail volume are left in the mail stream, while the much higher number of small-format mailpieces are sorted out. As a result, the sorting is inefficient and moreover, the sorted-out majority of the letters that fall through the openings are subjected to considerable mechanical stress.

WO 03/035527 A1 describes a device for sorting and stacking mailpieces in which the mailpieces are fed via a conveyor belt to a sorting line at which the mailpieces that cannot be subsequently processed mechanically are sorted out. The other mailpieces move via the conveyor belt to a means where they are stacked in preparation for the subsequent processing steps. In order to process a large volume of mail, it can be provided that several sorting stations are set up from which the mailpieces that cannot be processed mechanically are first placed onto another conveyor belt that connects the sorting stations and they are then fed to the stacker via this conveyor belt.

The disclosed device has especially the drawback that the individual sorting stations have, a very complex structure with their own feed belts, slides and conveyor belts on which the sorting takes place and they take up a great deal of space, so that especially the processing of a large mail volume is ineffective.

German Published Examined Application DE 1 054 015 discloses a device for sorting mailpieces wherein the mailpieces are initially lying flat on a spiral conveying line on whose outer wall flat mailpieces move through slits to reach a conveying channel, whereas mailpieces of a greater thickness remain on the conveying means. Within the conveying channel, the flat mailpieces are set upright and conveyed along passage openings through which the mailpieces having a small height are diverted into secondary channels while the other mailpieces remain in the conveying channel.

The object of the invention is to create the capability for a reliable sorting of mailpieces according to mail classes and mail formats in the simplest possible manner, also in cases of a large mail volume.

According to the invention, this object is achieved by a method according to claim 1.

According to the invention, this object is also achieved by a device according to claim 9.

Advantageous refinements of the method and of the device are the subject matter of the subordinate claims.

In particular, the invention proposes that a method for sorting mailpieces according to their formats be carried out in such a way that mailpieces having at least two formats are fed by a first conveying means to a sorting line, that mailpieces having a first format are removed from the first conveying means in the area of the sorting line at several sorting stations arranged one after the other in the conveying direction of the first conveying means, and said mailpieces are fed to a second conveying means that runs in the area of the sorting line laterally next to the first conveying means, and that the mailpieces having other formats remain on the first conveying means.

The first format is preferably the format that occurs with the lowest frequency in a mail volume. In particular, the first format is preferably a large format in which the dimensions of the mailpieces exceed pre-specified values.

The method makes it possible for the mailpieces having formats that occur in small numbers to be removed from the first conveying means, while most of the mailpieces that have another format that differs from the first format remain on the first conveying means. In this manner, an especially fast and gentle sorting of the mailpieces is achieved.

The mailpieces with the other formats are, for example, small-format mailpieces a small format, which are present in much larger numbers in the usual mail volume than are mailpieces having the large format.

Moreover, the sorting is advantageously carried out at several sorting stations that are arranged one after the other along the first conveying means in the conveying direction, so that mailpieces having the first format that could not be removed from the first conveying means at a first sorting station are sorted out at one of the following sorting stations of the sorting line.

The sorting of the mailpieces at the sorting stations is thus not independent of each other but rather complementary. This results in a particularly reliable sorting which guarantees, to the greatest extent possible, that all of the mailpieces having the first format are removed from the first conveying means.

In an advantageous embodiment of the method, the mailpieces having the other formats are conveyed away from the sorting line by the first conveying means. This allows an especially simple construction of the device for carrying out the method.

The mailpieces are typically delivered to a distribution center of a postal service provider in containers, for example, in boxes or in bags. In an especially advantageous embodiment of the method according to the invention, the containers are emptied onto the first conveying means or onto another conveying means located upstream from the first conveying means. As a result, corresponding to the emptying of the containers, piles of mailpieces are created on the first conveying means and these are conveyed to the sorting line.

In an especially advantageous embodiment of the method, it is proposed that the first conveying means is stopped once such a pile has reached the sorting line. In this manner, sufficient time is available at the sorting line to recognize and sort out all of the mailpieces having the first format.

Advantageously, it can also be provided that the mailpieces are segregated before they reach the sorting line. In this manner, the piles are at least partially broken up so that an especially simple sorting at the sorting line is made possible and, in particular, a simple and fast recognition of mailpieces having the first format is possible.

In another preferred embodiment of the method, the mailpieces are accumulated on the first conveying means in the area of the sorting line so as to keep them in the area of the sorting line for a longer time.

This can be advantageously achieved in that the first conveying means ends in the downstream end area of the sorting line so that the mailpieces can be accumulated in front of the end section of the conveying means in a simple manner.

In an advantageous embodiment of the method, the mailpieces having the other formats that have been accumulated on the first conveying means in the area of the sorting line are fed to a third conveying means.

In the area of the sorting line, the third conveying means advantageously runs parallel to the first conveying means, and the small-format mailpieces are pushed off of the first conveying means onto the third conveying means once the mailpieces having the first format have been removed from the first conveying means.

After the sorting at the sorting line, at least the mailpieces with the other formats are segregated, set upright and stacked with aligned edges so that they can be fed to the subsequent automated processing steps.

Moreover, an advantageous refinement of the method is characterized in that the mailpieces having the first format are removed from the first conveying means and these mailpieces are fed to the second conveying means by means of a robot, at least at some of the sorting stations.

In this context, the term "robot" is to be understood in its broadest sense as a programmable manipulator. In particular, the robot is a reprogrammable multifunctional manipulator for carrying out variable programmable movement sequences as per the definition of the robot according to the specifications of the Robotic Institute of America.

The method according to the invention is thus advantageously suitable especially for sorting the mailpieces according to two formats. However, it can be further refined in a simple manner so that, in several sorting steps, sorting according to three or more formats is carried out in that those mailpieces that were taken away from the sorting line where the mailpieces having the first format are removed from the conveying means are fed, in the same manner, to another sorting line where the mailpieces having a second format are sorted out.

This can be carried out advantageously in that the mailpieces having the other formats are fed by the first conveying means to another sorting line where mailpieces having a second format are removed from the first conveying means and fed to a fourth conveying means. This, in turn, is preferably carried out at several sorting lines arranged one after the other along the first conveying means in the conveying direction.

The sorting at the other sorting line is preferably carried out in such a way that the format selected as the second format is the one that occurs with the lowest frequency within the mail volume having the other formats and that is consequently the format with the second-lowest frequency within the total mail volume. In this manner, the advantages of the method according to the invention in terms of fast and gentle sorting of the mailpieces are fully utilized.

In addition to the method, the invention also provides a device that is especially advantageously suited for carrying out the method.

The device for sorting mailpieces according to formats is especially characterized in that it comprises a first conveying means for feeding mailpieces having at least two formats to a sorting line with several sorting stations arranged one after the other along the first conveying means in the conveying direction thereof, and a second conveying means for receiving mailpieces having a first format runs in the area of the sorting line laterally next to the first conveying means on which the mailpieces with other formats remain.

The arrangement of the sorting stations at the sorting line makes it possible for the mailpieces having the first format that could not be removed from the first conveying means at a first sorting station to be removed at another sorting station and fed to the second conveying means.

The term conveying means is not to be construed in any limiting manner whatsoever within the scope of the invention but rather in its broadest sense. In particular, belt conveyors or containers being conveyed on a belt conveyor or on a roller conveyor are fundamentally suitable for use in the invention as the conveying means.

In an advantageous embodiment of the device, all of the sorting stations are arranged on a first side of the first conveying means. The second conveying means is advantageously arranged laterally on a second side of the first conveying means, opposite from the first side.

This arrangement allows a simple and ergonomic sorting of the mailpieces with which the mailpieces having the first format that have been removed from the first conveying means are fed via the first conveying means to the second conveying means.

In a preferred embodiment of the device, it is provided that a mechanism is present that can be operated from at least one sorting station in order to stop the first conveying means so that it can be stopped from the sorting station when large piles of mailpieces are fed to the sorting line. This ensures that sufficient time is available for the sorting of the mailpieces.

In another preferred embodiment, at the sorting line, the device has a mechanism for accumulating the fed mailpieces at the sorting line so that the retention time of the mailpieces at the sorting line is still sufficiently long, even if the first conveying means is not stopped.

The mechanism for accumulating the mailpieces is advantageously a downstream end section of the first conveying means.

Advantageously, it is also provided that, in the area of the sorting line, a third conveying means for receiving the mailpieces having the other formats runs parallel to the first conveying means. The mailpieces that have accumulated in front of the end section of the first conveying means can be fed to the third conveying means after the mailpieces having the first format have been sorted out.

In this context, a particularly space-saving and ergonomic approach is for the third conveying means to be arranged below the second conveying means. Advantageously, the second conveying means is offset upwards in terms of its height relative to the first conveying means. Moreover, the third conveying means is advantageously offset downwards in terms of its height relative to the first conveying means.

In another advantageous embodiment of the device, it is also provided that a robot is installed in at least one sorting station in for removing the large-format mailpieces from the first conveying means and for feeding these mailpieces to the second conveying means.

In order to sort mailpieces according to three or more formats in accordance with the above-mentioned method, preferably several devices configured according to the invention are arranged one after the other and joined to each other in such a way that the mailpieces that were not removed from the mail stream at a given device are fed to another device.

Moreover, in an advantageous embodiment of the invention, it is provided that, in the area of the sorting line, the second conveying means runs parallel to the first conveying means.

In another advantageous embodiment, it is provided that, in the area of the sorting line, the second conveying means runs along an ascending course relative to the first conveying means.

Additional advantages, special features and practical refinements of the invention will be understood from the description below of preferred embodiments making reference to the drawing figures.

DETAILED DESCRIPTION

Figure 1:
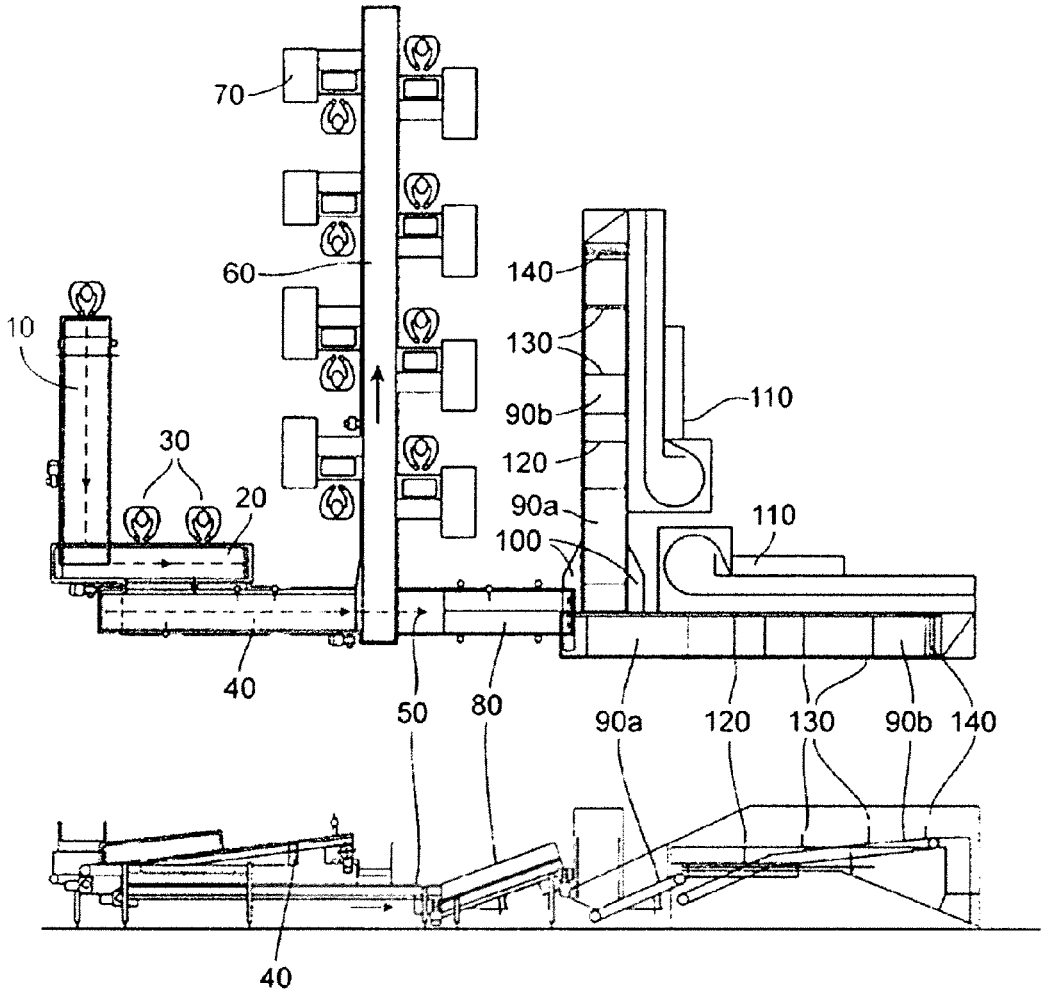
FIG. 1 in one embodiment, a top view of a means for processing incoming mail in a distribution center and a section through this means, FIG. 2 in another embodiment, a top view of a means for processing incoming mail in a distribution center, FIG. 2*a* a first longitudinal section through the means shown in FIG. 2 along line C-C, FIG. 2*b* a second longitudinal section through the means shown in FIG. 2 along line B-B, FIG. 2*c* cross sections through the means shown in FIG. 2 along line A-A, FIG. 3 a cross section of a pre-segregation means for segregating mailpieces, FIG. 4*a* a cross section of a fine segregation means for segregating mailpieces, FIG. 4*b* a view of the fine segregation means shown in FIG. 4*a*.
Figure 2:
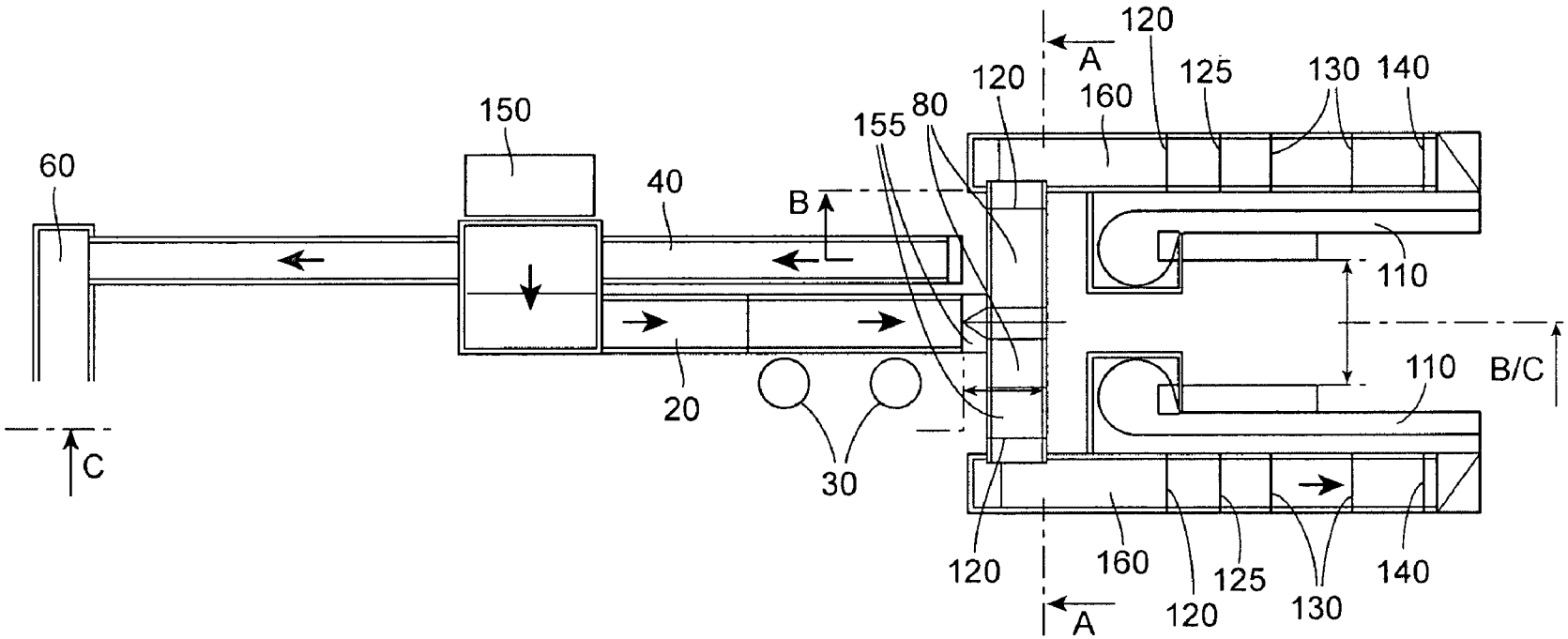
Figure 2A:
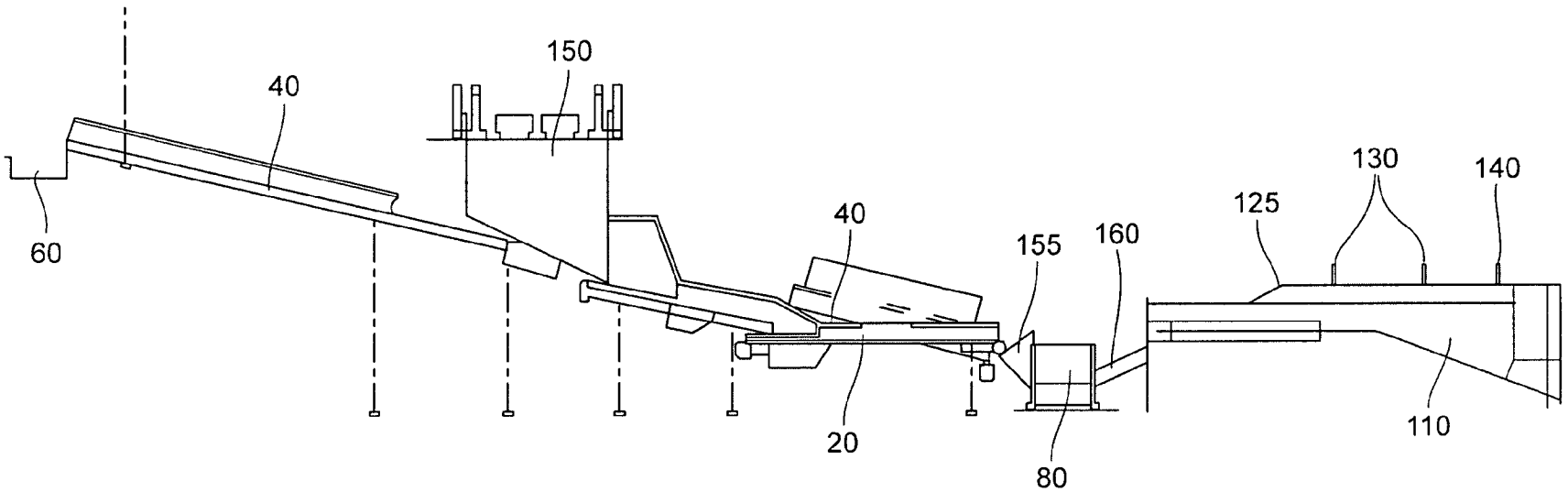
Figure 2B:
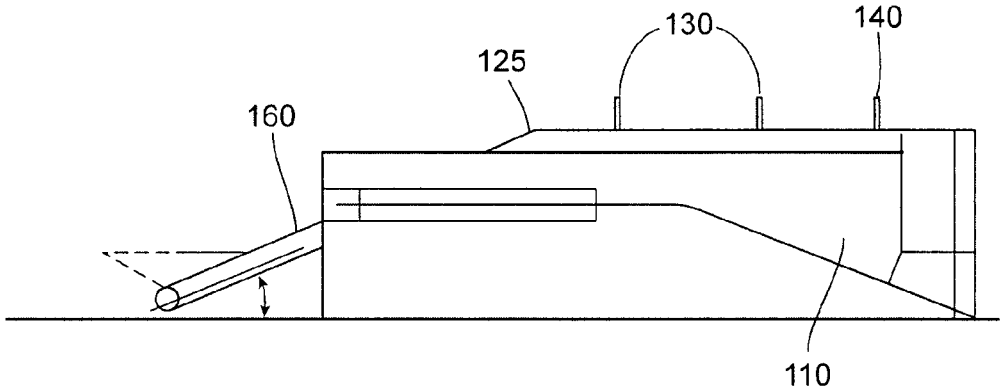
Figure 2C:
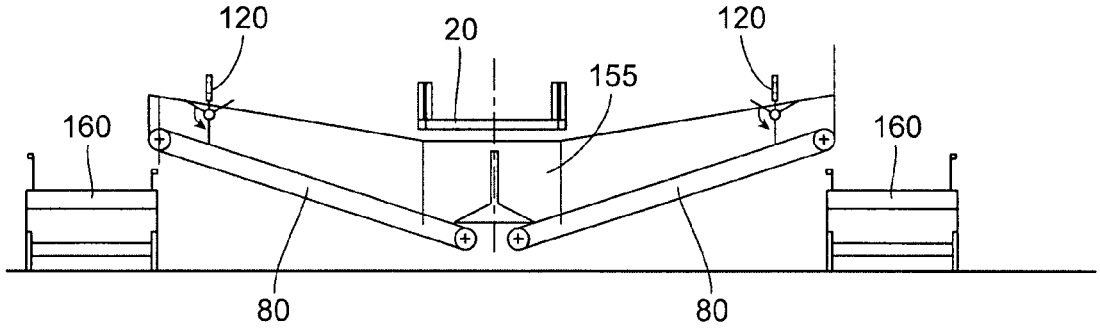

The invention will be described below with reference to the example of embodiments that allow the use of the invention by the applicant. However, the invention is by no means limited to these embodiments and can fundamentally be adapted to the circumstances of any postal service provider.

The invention makes it possible to quickly and reliably carry out the processing of incoming mail in a distribution center of a postal service provider that will be referred to as a mail center below and in conjunction with the applicant.

In a mail center (BZ), the mailpieces that have been mailed by their sender in a mailbox or that have been dropped off at a branch office of the applicant or at another drop location such as, for example, the mail center itself, are first taken to the so-called mail organizing hall.

These are mailpieces having the entire range of formats handled by the applicant. The formats associated with the individual classes of mail are compiled in the table below.

| Class of mail | Length (mm) | Width (mm) | Height (mm) | Weight (g) |
|---|---|---|---|---|
| Postcard | 140-235 | 90-125 | | |
| Standard letter (SBf) | 140-235 | 90-125 | max. 5 | max. 20 |
| Compact letter (KBf) | 100-235 | 90-125 | max. 5 | max. 50 |
| Large letter (GBf) | 100-353 | 70-250 | max. 20 | max. 500 |
| Oversize letter (MBf) | 100-353 | 70-250 | max. 50 | max. 1000 |

Moreover, the length of postcards, standard letters and compact letters has to equal at least 1.41 times the width.

The invention is by no means limited to the classes of mail and formats that are handled in the area of the applicant and that are listed here by way of an example. In the same manner, it can be used for sorting mailpieces of any classes of mail and formats.

The hourly mail volume to be sorted in the mail organizing hall is about 42,500 mailpieces. Specifically, the mail volume consists of about 36,000 standard and compact letters as well as postcards (SKBf) and about 6000 large and oversize letters combined.

The subsequent automated sorting of the mailpieces according to their destination is prepared in the mail organizing hall. For this purpose, the mailpieces are sorted according to mail formats and stacked in mail containers for the further processing in downstream sorting and distribution stations.

In this process, mail containers are provided in three different sizes for the transportation of the mailpieces. Standard and compact letters as well as postcards (SKBf) are allocated to containers of size 1 (Beh1) into which the mailpieces are placed in an upright position, large letters (GBf) are allocated to containers of size 2 (Beh2) and oversize letters (MBf) are allocated to containers of size 3 (Beh3), whereby large letters (GBf) and oversize letters (MBf) are transported lying flat and stacked in the containers Beh2 or containers Beh3.

The mailpieces are dropped off in the mail organizing hall into containers Beh3 that are tipped over above the receiving belt 10. This is done manually or else by means of a suitable tipping device 150. The receiving belt 10 is preferably configured as a belt conveyor with a smooth belt.

Via the receiving belt 10, the mailpieces are conveyed to a pre-separating belt 20 that is preferably arranged at a right angle to the receiving belt 10. The receiving belt 10 is situated at a higher level than the pre-separating belt 20 and extends beyond it by a maximum of half its width.

Via the downstream end of the receiving belt 10, the mailpieces reach the pre-separating belt 20 that is likewise configured as a belt conveyor with a smooth belt.

The arrangement of the receiving belt 10 and of the pre-separating belt 20 at a right angle relative to each other ensures a metered feed of the mailpieces onto the pre-separating belt 20.

It can be provided for the conveying speed of the receiving belt 10 to be adjusted to the mail volume. In this manner, the conveying speed can be slowed down when a large number of mailpieces are present on the receiving belt 10 so that a greater segregation effect is achieved. Moreover, in case of an especially large number of mailpieces, the receiving belt 10 can be stopped until the preceding mailpieces on the pre-separating belt 20 have been completely or almost completely processed.

The sorting line is situated at the pre-separating belt 20 and it comprises at least one sorting station 30. In order to achieve an especially effective sorting of the mailpieces, the sorting line preferably comprises two or more sorting stations 30.

At the sorting station, large letters and oversize letters are sorted out of the mail stream and fed to the large/oversize letter belt 40. This is a conveyor belt that, at least in the area of the sorting line, runs laterally next to the pre-separating belt 20 and that is situated at a small distance from the pre-separating belt 20 on the side of the pre-separating belt 20 that is opposite to the side on which the sorting stations 30 are arranged. Preferably, the large/oversize letter belt 40 is likewise configured as a belt conveyor with a smooth belt. The large/oversize letter belt 40 can run so as to be parallel to the pre-separating belt or else along an ascending course.

The sorting is carried out at the sorting stations 30 by postal workers who recognize the large letters and oversize letters in the mail stream, pick them up from the pre-separating belt 20 and place them onto the large/oversize letter belt 40. In an alternative embodiment of the invention, at least in some of the sorting stations 30, the sorting can also be performed in a similar manner by robots that are equipped for this purpose. In particular, the robots can have gripper arms.

Due to the presented layout of the pre-separating belt 20 and of the large/oversize letter belt 40, the large letters and oversize letters can easily be fed to the latter belt. Furthermore, this configuration makes it possible for several sorting stations 30 to be arranged one after the other in the conveying direction of the pre-separating belt 20, where a postal worker or a robot sorts the large letters and oversize letters out of the mail stream and feeds them to the large/oversize letter belt 40. This significantly reduces the error rate during the recognition and sorting out of large letters and oversize letters since large letters and oversize letters that could not be sorted out at a first sorting station 30 are sorted out at a subsequent sorting station 30 and fed to the large/oversize letter belt 40.

As far as large letters and oversize letters are concerned, these make up only about 15% of the mailpieces delivered to the mail organizing hall that have to be sorted out of the mail stream. The other 85% of the mail volume passes through the sorting line without special work steps having to be carried out. Hence, the invention allows an extremely fast, effective and gentle sorting of the mailpieces according to mailpiece formats.

In an advantageous embodiment of the invention, the pre-separating belt 20 and/or the receiving belt 10 can be controlled from at least one sorting station 30. The mail workers and/or robots that are performing the sorting can appropriately control the drive of the pre-separating belt 20 and/or of the receiving belt 10 in order to influence the rate at which mailpieces are fed to the sorting line.

In particular, the conveying speed of the receiving belt 10 can be lowered in order to achieve a better segregation of the letters when they are transferred from the receiving belt 10 to the pre-separating belt 20. By the same token, the speed of the pre-separating belt 20 can be reduced to the value of 0 so that there is sufficient time to process the mailpieces that are present on the pre-separating belt 20. This approach can be utilized particularly whenever an especially large mail volume is present on the pre-separating belt 20.

Preferably, when the conveying speed of the pre-separating belt 20 is lowered, the speed of the receiving belt 10 is likewise reduced in order to prevent excessively large piles of mailpieces from accumulating on the pre-separating belt 20. For this purpose, a control unit for controlling the pre-separating belt 20 and the receiving belt 10 is configured in such a way that, when the speed of the pre-separating belt 20 is lowered, the conveying speed of the receiving belt 10 is likewise reduced by a certain ratio or else the receiving belt 10 is stopped.

The pre-separating belt 20 and the receiving belt 10 are controlled from the sorting station(s) 30, in each case by means of a switch that is preferably configured as a foot switch, in order to allow simple operation during the sorting. Advantageously, two or more speed levels are provided in order to simplify the operation even further.

If the sorting is being carried out by a robot, the pre-separating belt 20 and the receiving belt 10 are preferably controlled by the control unit of the robot.

In the embodiment of the device according to the invention, which is shown in a top view in FIG. 1, the pre-separating belt 20 ends in a downstream area of the sorting line, and the postal workers and/or robots at the sorting stations 30 push the standard and compact letters (SKBf) remaining on the pre-separating belt 20 onto a standard and compact letter (SKBf) belt 50 that runs parallel to the pre-separating belt 20 in the area of the sorting line. As a delineation of the pre-separating belt 20, preferably a barrier is provided at a height that prevents mailpieces from being compressed by the pre-separating belt 20 due to a back pressure that builds up in front of the end of the belt.

In this embodiment, the large/oversize letter belt 40 is at a higher level than the pre-separating belt 20, the standard and compact letter (SKBf) belt 50 is lower than the pre-separating belt 20 and runs below the large/oversize letter belt 40 in the area of the sorting line. For example, the large/oversize letter belt 40 is arranged 350 mm above the level of the pre-separating belt 20 and the standard and compact letter (SKBf) belt 50 is 350 mm below this level.

The large letters (GBf) and the oversize letters (MBf) are fed via the large/oversize letter belt 40 to a canceling belt 60 that follows the former, that is aligned at a right angle to the large/oversize letter belt 40 and that is preferably likewise configured as a belt conveyor with a smooth belt.

Several canceling stations 70 are arranged along the canceling belt 60 where a postal worker and/or an appropriately equipped robot picks up the large letters (GBf) and the oversize letters (MBf) from the canceling belt 60, checks whether a mailpiece has sufficient and valid postage and, after verifying the postage, provides the mailpieces with a postage cancellation.

At least one container Beh2 and one container Beh3 are placed on the side of the canceling stations 70 opposite from the canceling belt 60, and the canceled large letters (GBf) and oversize letters (MBf) are placed into these containers by the postal workers and/or robots at the canceling stations 70. Preferably, at each canceling station 70, there is another container Beh3 that is filled with the large letters (GBf) and the oversize letters (MBf) that do not have sufficient or valid postage.

A conveying device takes the containers Beh2 and Beh3 away from the area of the canceling stations 70 in automated procedure for purposes of further processing the mailpieces or the containers Beh2 and Beh3 are removed manually from the area of the canceling stations 70, and these containers are replaced with empty containers once they have been completely filled.

The standard and compact letters (SKBf) are transported by the standard and compact letter (SKBf) belt 50, which is likewise configured as a belt conveyor with a smooth belt, onto an inclined conveyor 80 that follows the standard and compact letter (SKBf) belt 50 and that is preferably oriented in the conveying direction of the standard and compact letter (SKBf) belt 50. In an advantageous embodiment of the invention, the inclined conveyor 80 is configured as an ascending belt conveyor.

The standard and compact letter (SKBf) belt 50 is put into operation as soon as the pre-separating belt 20 has been switched on by the postal workers. The running time of the standard and compact letter (SKBf) belt 50 is regulated by a timing element. In the transition area of the standard and compact letter (SKBf) belt 50 to the inclined conveyor 80, there is a light barrier in a trough and said light barrier puts the belt into operation once a certain filling level has been reached.

The mailpieces are transported by the inclined conveyor 80 into troughs of subsequent buffer belts 90*a* that are preferably configured as ascending belt conveyors.

Filling level sensors are likewise installed in the troughs of the buffer belts 90*a* and preferably they comprise a light barrier as well. If one or both of the filling level sensors respond, the upstream belts and thus the further mail feed are stopped. The controls of the upright-setting modules 110 are coupled to those of the segregation belts.

After the segregation and upright-setting units have been put into operation, the buffer belts 90*a* transfer the mailpieces to the segregation belts 90*b*. If the transfer area of the buffer belts 90*a* and of the segregation belts 90*b* becomes overfilled, the upstream conveyor belts are switched off.

At the ends of the segregation belts 90*b*, the mailpieces move through slides into vertical conveying channels of the upright-setting modules 110. In the vertical conveying channels, the mailpieces are transported via an incline into horizontal segregation segments where they are stacked so as to be upright and with aligned edges at end positions of the upright-setting module 110.

At the end of the end position, there is a letter container placement area with a container (Beh1) into which the operator pushes the stack of mailpieces so that they can be further transported into downstream sorting stations.

Below the belt turning point of the segregation belts 90*b*, there is a pre-segregation means 120 that consists of a shaft with three webs that rotates opposite to the conveying direction. A detailed description of the pre-segregation means is provided below in this description.

By means of the pre-segregation belt 120, the mail stream is smoothed and sizable piles in the stream of standard and compact letters (SKBf) are broken up.

The buffer belts 90*a* are preferably arranged at a right angle relative to each other in such a way that a first buffer belt 90*a* oriented in the conveying direction of the inclined conveyor 80 adjoins a longitudinal axis that is offset in a horizontal direction relative to the longitudinal axis of the inclined conveyor 80 at the end section thereof, and the second buffer belt 90*a* projects into a cross sectional area of the inclined conveyor 80 in such a way that the upstream end area of the buffer belt 90*a* is laterally adjacent to the end of the inclined conveyor 80 whose end section is adjacent to one side of the first buffer belt 90*a*.

Preferably, the buffer belts 90*a* are lowered relative to the level of the downstream end of the inclined conveyor 80 and they have a trough-like configuration at their upstream end in the area that follows the inclined conveyor 80. Consequently, the standard and compact letters (SKBf) fall from the downstream end of the inclined conveyor 80 into the trough of one of the buffer belts 90*a* and the buffer belt 90*a* transports them away from the connection area to the inclined conveyor 80.

The connection area is preferably constructed in such a way that the mailpieces are distributed uniformly along the two buffer belts 90*a*. Moreover, it can be provided that the second buffer belt 90*a* is laterally not directly adjacent to the end section of the inclined conveyor 80 but rather is provided with slanted metal plates 100 laterally in the connection area for purposes of receiving the standard and compact letters (SKBf).

The segregation belts 90*b* adjoin the buffer belts 90*a* and are preferably oriented in the lengthwise direction of the buffer belts 90*a*. The segregation belts 90*b* are preferably inclined conveyor belts with an incline that is less in the downstream area of a belt turning point than in its upstream area. It can likewise be provided for the segregation belts to be oriented horizontally.

A pre-segregation belt 120 and two fine segregation means 130 are installed one after the other along the segregation belts 90*b* in the conveying direction. Through the use of the segregation means, it is achieved that the standard and compact letters (SKBf) are homogeneously distributed on the segregation belts 90, whereby the standard and compact letters (SKBf) are arranged uniformly next to each other on the segregation belts 90. The fine segregation means 130 are preferably at a distance of about 1000 mm from each other and they are designed as a shaft with two webs that rotates opposite to the conveying direction of the segregation belts 90. For a more detailed presentation of the fine segregation means 130, reference is hereby likewise made to the explanations below in this description.

The standard and compact letters (SKBf) are conveyed via the segregation belts 90 to upright-setting modules 110. Upstream from the transitions to the upright-setting modules 110, there is a height control unit 140 that switches off the segregation belt 90*b* and, in one conceivable embodiment, likewise the appertaining buffer belt 90*a*, whenever mailpieces with excess height are detected on this belt that cannot be properly processed in the upright-setting module 110. Typically, these are mailpieces that have a height of more than 10 mm but, due to their length and width, were not recognized by the postal workers and/or robots at the sorting stations 30 as being large letters (GBf) or oversize letters (MBf).

The height control unit 140 is preferably configured as a flap that can pivot above the segregation belts 90 and that is arranged perpendicular to their conveying direction, said flap actuating an end switch at the end of its pivoting range that switches off the segregation belt 90. The height of the flap above the belt of the segregation belt 90 is preferably adjustable within the range from 5 mm to 20 mm.

In case of a stoppage brought about by the height control unit 140, the mailpieces with excess height are removed from the mail stream and fed to the processing lines intended for this mailpiece format for purposes of further processing.

It can also be provided that the second segregation belt 90*b*, possibly together with the appertaining buffer belt 90*a* and/or the inclined conveyor 80 and/or the standard and compact letter (SKBf) belt 50, are likewise switched off when one segregation belt 90 is switched off, so as to prevent mailpieces from accumulating on these conveyor belts.

From the downstream belt end of the segregation belts 90*b*, the standard and compact letters (SKBf) first go into the chute of the vertical conveying installation of the upright-setting module 110, said chute having a convex side wall in the connection area to the segregation belt 90 and the upper edge of this side wall being adjacent to the end of the segregation belt 90.

The embodiment of the invention described above is especially well-suited for use in a mail organizing hall in a small or medium-sized mail center of the applicant involving an hourly mail throughput of up to 42,500 mailpieces. Below, another embodiment of the invention with the same scope of performance will be explained which can be connected to the existing conveyor installations in large mail centers of the applicant.

The embodiment in question is shown in FIGS. 2 and 2*a* to 2*c*.

At a tipping device 150, containers (Beh3) filled with mail that has been collected from mailboxes are pivoted on a swiveling frame by 180° around the longitudinal axis. In this process, the mailpieces fall via a metal slide onto a storage belt from which the mailpieces are conveyed in a metered manner to a subsequent pre-separating belt 20.

The sorting line comprising at least one sorting station 30 is arranged along the pre-separating belt 20. Particularly in a large mail center with a high mail volume, however, preferably several sorting stations 30 are provided so that all of the large letters (GBf) and oversize letters (MBf) can be reliably sorted out of the mail stream.

The sorting at the sorting stations 30 is carried out in the same manner as in the already described embodiment of the invention. In particular, the large letters (GBf) and oversize letters (MBf) are removed from the pre-separating belt 20 by the postal workers or robots at the sorting stations 30 and placed onto the large/oversize letter belt 40 that, in the area of the sorting line, runs laterally next to the pre-separating belt 20 and is situated at a small distance from the pre-separating belt 20 on the side of the pre-separating belt 20 that is opposite to the side on which the sorting stations 30 are arranged. In this process, the large/oversize letter belt 40 can be oriented parallel to the pre-separating belt or else can run along an ascending course. Preferably, the large/oversize letter belt 40 is likewise configured as a belt conveyor with a smooth belt.

In contrast to the above-described embodiment of the invention, in this particular embodiment, the large/oversize letter belt 40 transports the large letters (GBf) and oversize letters (MBf) opposite to the conveying direction of the pre-separating belt 20. In an advantageous configuration, the large/oversize letter belt 40 in this embodiment is configured as an inclined conveyor with a crosspiece belt so that an initial segregation of the large letters (GBf) and oversize letters (MBf) already takes place in the area of the sorting line.

Via the large/oversize letter belt 40, large letters (GBf) and oversize letters (MBf) are fed to a canceling belt 60 from which they are removed for purposes of checking the postage and for cancellation at the canceling stations 70. The canceling belt 60 and the canceling stations 70 are not shown in FIGS. 2 and 2*a* to 2*c*. They are preferably configured in the same manner already explained in conjunction with FIG. 1.

Two inclined conveyors 80 are arranged at the downstream belt end of the pre-separating belt 20 following the sorting line, each of these inclined conveyors 80 being arranged in a line at a right angle to the pre-separating belt 20 and their lower belt ends being adjacent to each other along the longitudinal axis of the pre-separating belt 20. From the pre-separating belt 20, the standard and compact letters (SKBf) remaining there after the sorting move into the trough area between the two inclined conveyors 80 whose lower belt ends are arranged below the level at which the pre-separating belt 20 is located. In a preferred embodiment of the invention, a slide 155 and/or a funnel is provided in order to feed the standard and compact letters (SKBf) from the pre-separating belt 20 to the trough area.

In this embodiment, the inclined conveyors 80 are likewise preferably configured as belt conveyors with a crosspiece belt.

At the upper belt end of each of the inclined conveyors 80, there is a pre-segregation belt 120 that is configured in the manner described further below.

The standard and compact letters (SKBf) each fall from the upper belt ends of the inclined conveyors 80 onto a segregation belt 160 that is partially configured as an inclined conveyor. Moreover, in the area of the lower belt end, in the transfer area to the inclined conveyors 80, the segregation belt 160 is preferably configured so as to be trough-like.

From the lower belt end of the segregation belts 160, the standard and compact letters (SKBf) move via a rising segment to a belt turning point 125 which is followed in the downstream conveying direction by a horizontally aligned area of the segregation belt 160. In order to smooth the mail stream and to break up piles of standard and compact letters (SKBf) that might be present, a pre-segregation belt 120 is mounted on the segregation belt 90 below the belt turning point 125 at a small distance from it.

In the horizontal area of the segregation belts 160, at a distance of preferably about 1000 mm, two fine segregation means 130 are installed that are configured in the manner described below. By means of the fine segregation means 130, the mail stream is transferred onto the segregation belts 160 into a stream of standard and compact letters (SKBf) lying next to each other and homogeneously distributed over the segregation belts 160.

In the downstream end area of the segregation belts 160, there is a height control unit 140 that is configured and functions in the way that was described in conjunction with the embodiment of the invention shown in FIG. 1.

After the standard and compact letters (SKBf) have passed the height control unit 140, they move via the downstream belt ends of the segregation belts 160 to an upright-setting module 110 that is configured in the manner already described above.

The control of the device in this embodiment is carried out similarly to the control in the embodiment shown in FIG. 1.

The conveying speed of the pre-separating belt 20 is controlled by the postal workers and/or the robots at the sorting stations 30 and adapted to the mail volume. In particular, the pre-separating belt 20 can be switched on and off by means of a foot switch located at the sorting stations 30.

Moreover, in advantageous embodiments of the invention, it can be provided that at least one additional speed level can be selected via the foot switch in order to further improve the possibility of adapting the conveying speed of the pre-separating belt 20 to the mail volume.

If the sorting of the mailpieces at the sorting line is carried out by robots, a corresponding control of the pre-separating belt 20 can be implemented directly by the control unit of the robots.

In this manner, it is also possible for the postal workers and/or robots to stop the pre-separating belt 20 until all of the large letters (GBf) and oversize letters (MBf) on the pre-separating belt 20 in the area of the sorting line have been sorted out. After the foot switch has been actuated, the standard and compact letters (SKBf) remaining on the pre-separating belt 20 are fed to the trough area between the two inclined conveyors 80.

This is where the filling level is monitored by a filling level sensor, which is done in the manner already described. If the filling level in the trough exceeds a pre-specified value, then the pre-separating belt 20 is taken out of operation by the filling level sensor until so many standard and compact letters (SKBf) have been transported out of the trough area by the inclined conveyors 80 that the filling level has dropped below a pre-specified value.

In the trough area at the lower belt ends of the segregation belts 160, the filling level is likewise monitored in the above-mentioned manner, and the mailpiece transfer by the inclined conveyors 80 is interrupted in that the inclined conveyors 80 are stopped. Once the filling level has dropped, the inclined conveyors 80 are put back into operation.

In a preferred embodiment, when the inclined conveyors 80 are switched off, the pre-separating belt 20 is likewise stopped in order to prevent an excessively large number of standard and compact letters (SKBf) from accumulating in the trough area between the inclined conveyors 80 while the conveyors are at a standstill.

Figure 3:
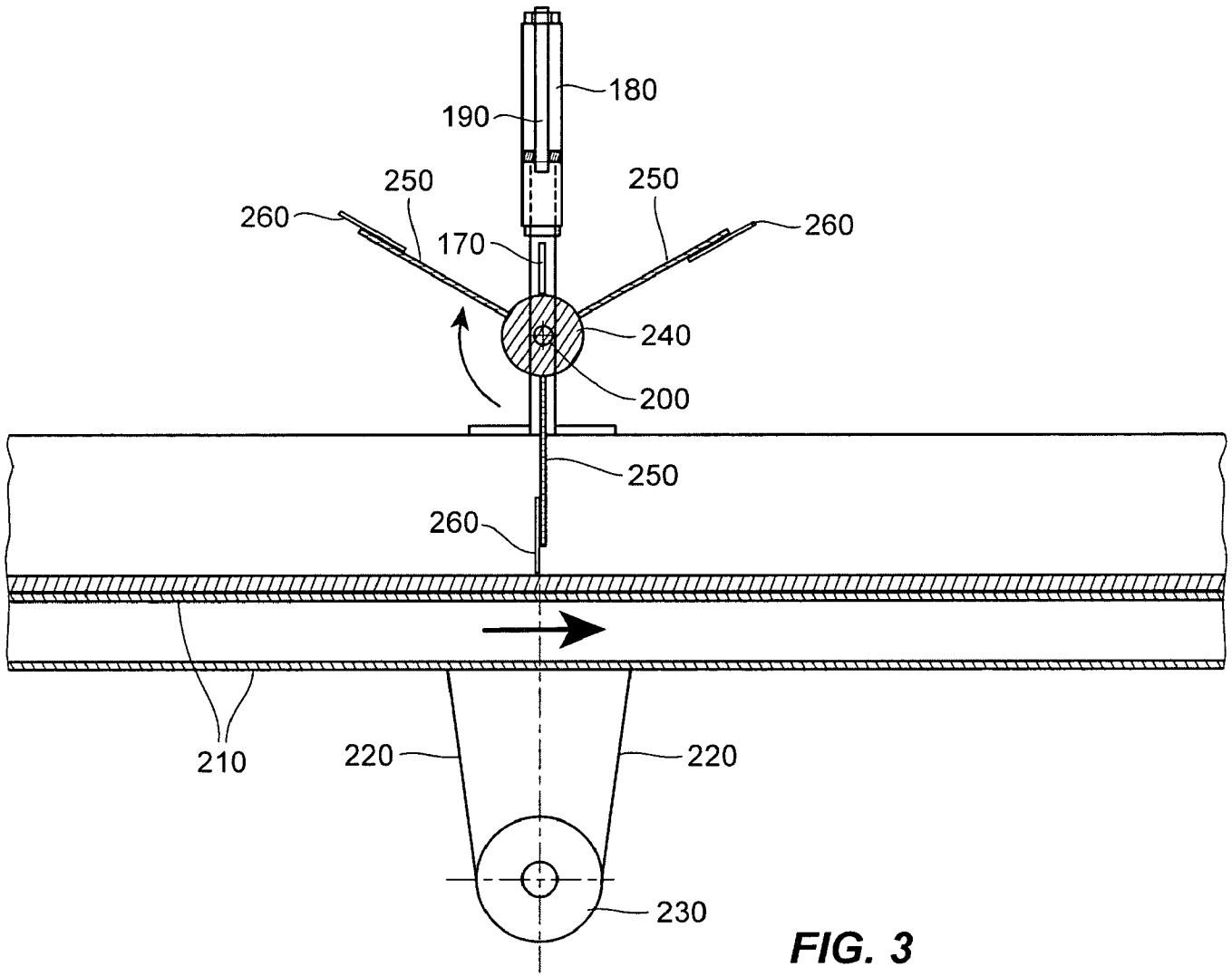
Figure 4A:
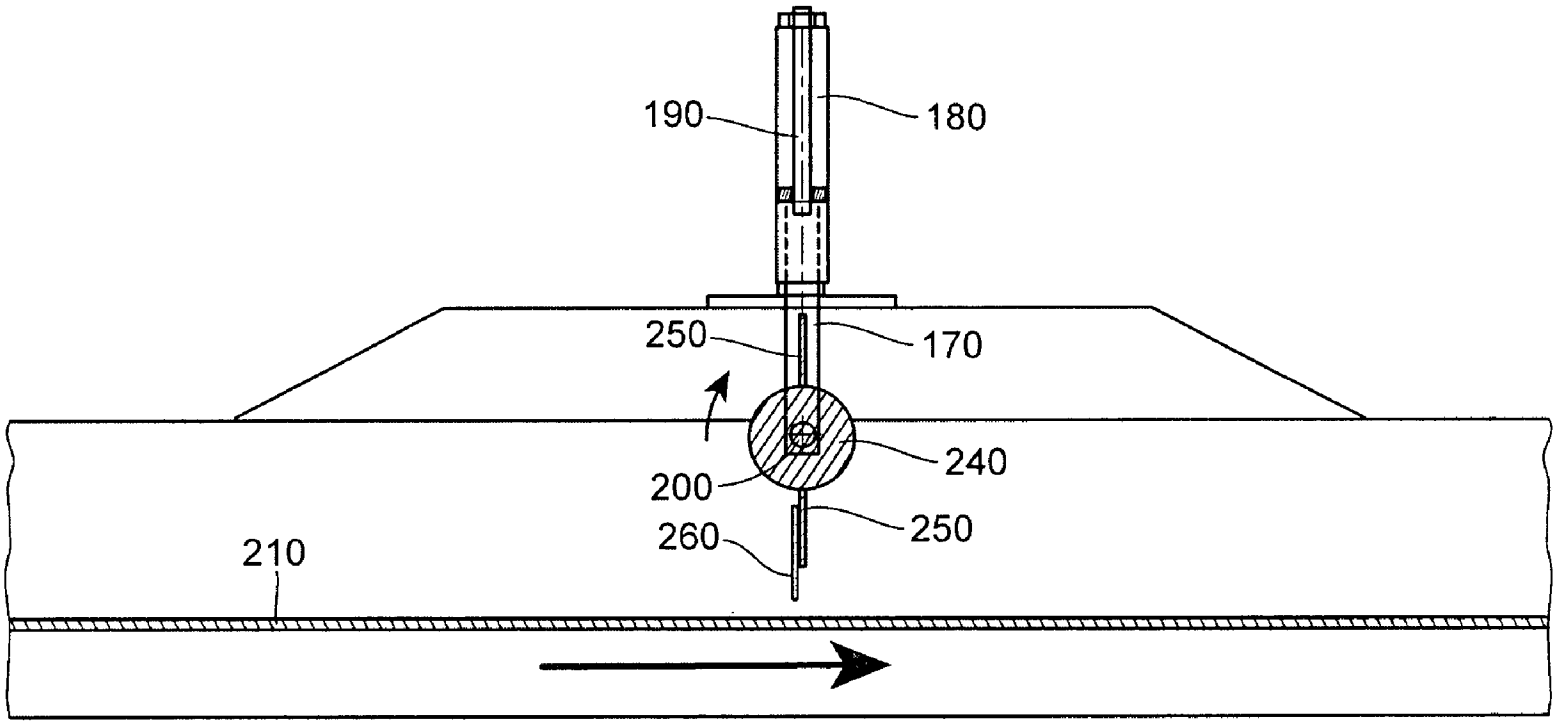
Figure 4B:
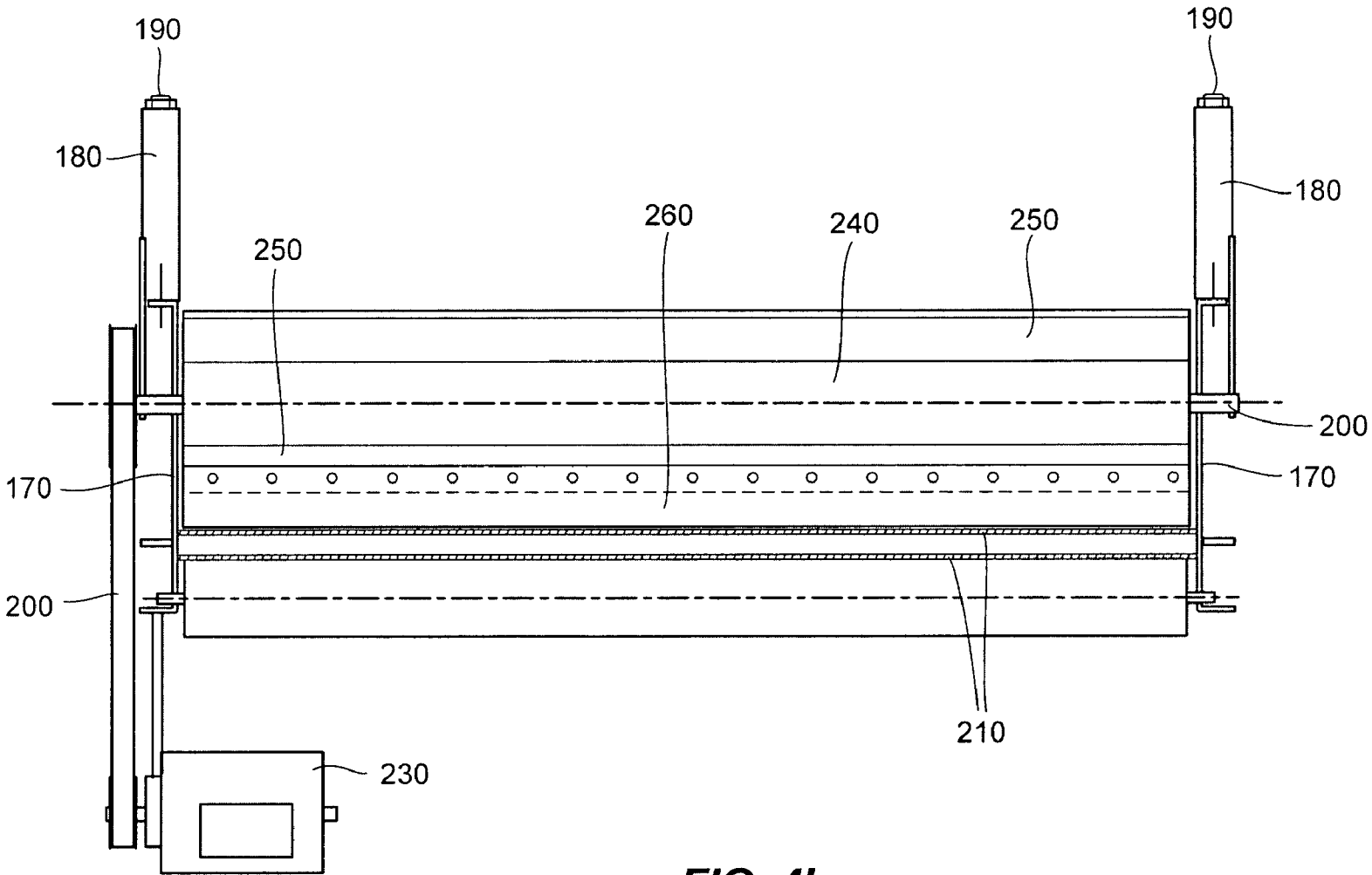

FIG. 3 shows a cross section of the pre-segregation belt 120 used in the above-mentioned device, while FIGS. 4*a* and 4*b* show the employed fine segregation means 130 that is configured in a similar manner.

The segregation means have two lateral attachments 170 that are attached opposite from each other in the side area of the conveyor belts and oriented vertically so as to be perpendicular to the belt plane of the conveyor belt. The attachments are configured to be tubular, for example, round, at least in the upper end area.

A suspension 180 has two lateral hollow tubes that are slipped onto the end areas of the attachments 170 and that serve to guide the attachments 170. Inside the tubes, there are screws 190 whose heads are firmly attached to the upper end section of the tube and that are screwed into a thread inside the tubular end areas of the attachment 170, thus allowing the height of the suspension above the conveyor belt 210 to be adjustable.

The suspension contains receptacles configured as pivot bearings for a shaft 200 that is arranged rotatably crosswise to the conveying direction above the conveyor belt 210. The shaft 200 is driven with a V-belt 220 by a motor 230, for example, an electric motor, and it is configured as a roller 240 or surrounded by a roller 240 in the area between the pivot bearings.

Radially oriented webs 250 are attached to this roller along the entire length of the roller 240 and, at least in part, these webs have elastic lips 260 as end pieces. The roller 240 is preferably attached at a height at which the lips 260 are only at a slight distance from the conveyor belt 210 when the web 250 is facing downwards. The lips 260 can be made, for example, of the same material as the belt.

The pre-segregation belt 120 has three webs 250 arranged at equal angular distances on the roller 240, the fine segregation means 130 has two webs 250 opposite from each other.

The shaft 200 of the segregation means is preferably driven in such a way that the webs 250 move opposite to the conveying direction of the conveying belt 210 when they are situated below the shaft 200. The angular speeds of the rotation of the shaft 200 is preferably adjustable within the range from 80 to 100 $min^{-1}$.

As a result of the rotational movement in the direction of rotation shown, the mailpieces located in front of the segregation means are thrown back and/or set uptight. Owing to the entraining movement of the webs 250, the mailpieces that have been set upright reach the downstream area of the segregation means. Moreover, depending on the momentary position of the webs 250, mailpieces move underneath the shaft 200 into the downstream area.

Consequently, in the downstream area of the belt conveyor, a random but homogeneous arrangement of mailpieces lying essentially next to each other on the belt 210 is created.

The segregation effect can be further enhanced if the segregation means are used in the upper end area of an inclined conveyor and some mailpieces are pushed back quite far down the incline.

| List of reference numerals | |
|---|---|
| Beh1 | mail container of size 1 |
| Beh2 | mail container of size 2 |
| Beh3 | mail container of size 3 |
| BZ | mail center |
| GBf | large letters |
| KBf | compact letters |
| MBf | oversize letters |
| SBf | standard letters |
| SKBf | standard and compact letters as well as postcards |
| 10 | receiving belt 10 |
| 20 | pre-separating belt |
| 30 | sorting station |
| 40 | belt for large and oversize letters (GBf/MBf belt) |
| 50 | belt for standard and compact letters (SKBf) belt) |
| 60 | canceling belt 60 |
| 70 | canceling station |
| 80 | inclined conveyor |
| 90a | buffer belt |
| 90b | segregation belt |
| 100 | receiving metal plates |
| 110 | upright-setting module |
| 120 | pre-segregation means |
| 125 | belt turning point |
| 130 | fine segregation means |
| 140 | height control unit |
| 150 | tipping device |
| 155 | slide |
| 160 | segregation belt |
| 170 | attachment |
| 180 | suspension |
| 190 | screw |
| 200 | shaft |
| 210 | conveying belt |
| 220 | V-belt |
| 230 | motor |
| 240 | roller |
| 250 | web |
| 260 | lip |

The invention claimed is:

1. A method for sorting mailpieces according to formats, comprising:

feeding mailpieces having at least two formats by a first conveyor to a sorting line, a first format being a large format in which dimensions of the mailpieces exceed pre-specified values, accumulating the mailpieces in an area of the sorting line in front of an end section of the first conveyor located in a downstream end area of the sorting line, removing mailpieces having the first format from the first conveyor in the area of the sorting line at several sorting stations arranged one after the other in a conveying direction of the first conveyor, and feeding mailpieces to a second conveyor that runs in the area of the sorting line laterally next to the first conveyor, and feeding the mailpieces having other formats that remain on the first conveyor to a third conveyor that is arranged below the second conveyor.

2. The method according to claim 1, comprising removing a mailpiece having the first format that was not removed from the first conveyor at a first sorting station from the first conveyor at a subsequent sorting station and feeding the mailpiece to the second conveyor.

3. The method according to claim 1, comprising consecutively emptying containers containing mailpieces of respectively varying sizes on the first conveyor, thereby arranging the mailpieces in spaced piles on the first conveyor as a result.

4. The method according to claim 1, comprising stopping the first conveyor once a pile of the mailpieces has reached the sorting line.

5. The method according to claim 1, comprising at the sorting line, pushing the mailpieces having the other formats off of the first conveyor onto the third conveyor once all of the mailpieces having the first format have been removed from the first conveyor.

6. The method according to claim 1, comprising removing the mailpieces having the first format from the first conveyor and feeding mailpieces to the second conveyor by means of a robot, at least some of the sorting stations.

7. The method according to claim 1, wherein the first format is the format that occurs with the lowest frequency in a mail volume.

8. A device for sorting mailpieces according to formats, comprising:

a first conveyor for feeding mailpieces of all formats to a sorting line, the first conveyor comprising an end section in a downstream end area in front of which the mailpieces are accumulated, whereby the sorting line comprises a plurality of sorting stations arranged one after the other on a first side of the first conveyor along the first conveyor in a conveying direction thereof, a second conveyor for receiving mailpieces having a first format, said second conveyor being arranged laterally on a second side of the first conveyor, opposite from the first side and running in the area of the sorting line laterally next to the first conveyor, and a third conveyor, for receiving mailpieces having formats other than the first format, that is arranged below the second conveyor.

9. The device according to claim 8, comprising a mechanism operated from at least one sorting station in order to stop the conveyor.

10. The device according to claim 8, comprising in the area of the sorting line, the third conveyor running parallel to the first conveyor.

11. The device according to claim 8, wherein the second conveyor is offset upwardly in terms of height relative to the first conveyor.

12. The device according to claim 8, wherein the third conveyor is offset downwardly in terms of height relative to the first conveyor.

13. The device according to claim 8, comprising a robot installed in at least one of the sorting stations in order to remove the mailpieces having the first format from the first conveyor and to feed subsequent mailpieces to the second conveyor.

14. The device according to claim 8, wherein the mailpieces having the first format are large-format mailpieces whose dimensions exceed a pre-specified value.

15. The device according to claim 8, wherein the second conveyor is a conveyor for receiving large-format mailpieces.

16. The device according to claim 8, wherein in the area of the sorting line, the second conveyor runs parallel to the first conveyor.

17. The device according to claim 8, wherein in the area of the sorting line, the second conveyor runs along an ascending course relative to the first conveyor.

18. The device according to claim 8, wherein the second conveyor is arranged laterally on one side of the first conveyor.

* * * * *